US010234798B2

(12) United States Patent
Watanabe et al.

(10) Patent No.: US 10,234,798 B2
(45) Date of Patent: Mar. 19, 2019

(54) FIXING DEVICE AND IMAGE FORMING APPARATUS INCORPORATING SAME

(71) Applicants: Yohhei Watanabe, Kanagawa (JP); Naoto Suzuki, Kanagawa (JP); Shinichi Namekata, Kanagawa (JP); Akiyasu Amita, Kanagawa (JP); Takashi Sakamaki, Kanagawa (JP); Teppei Kawata, Kanagawa (JP); Masateru Ujiie, Kanagawa (JP); Fumihiro Hirose, Kanagawa (JP)

(72) Inventors: Yohhei Watanabe, Kanagawa (JP); Naoto Suzuki, Kanagawa (JP); Shinichi Namekata, Kanagawa (JP); Akiyasu Amita, Kanagawa (JP); Takashi Sakamaki, Kanagawa (JP); Teppei Kawata, Kanagawa (JP); Masateru Ujiie, Kanagawa (JP); Fumihiro Hirose, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/020,155

(22) Filed: Jun. 27, 2018

(65) Prior Publication Data

US 2019/0018348 A1 Jan. 17, 2019

(30) Foreign Application Priority Data

Jul. 13, 2017 (JP) ..... 2017-137190

(51) Int. Cl.
*G03G 15/20* (2006.01)

(52) U.S. Cl.
CPC ..... *G03G 15/20* (2013.01); *G03G 15/2092* (2013.01)

(58) Field of Classification Search
CPC ..... G03G 15/20; G03G 15/2092
See application file for complete search history.

(56) References Cited

U.S. PATENT DOCUMENTS

2007/0217839 A1* 9/2007 Moteki ..... G03G 15/2028 399/329
2008/0260435 A1* 10/2008 Chikugo ..... G03G 15/2032 399/323

(Continued)

FOREIGN PATENT DOCUMENTS

JP 2005-201917 7/2005
JP 2008-165091 7/2008

(Continued)

*Primary Examiner* — Francis C Gray
(74) *Attorney, Agent, or Firm* — Duft & Bornsen, PC

(57) ABSTRACT

A fixing device includes a fixing rotator, a pressure rotator, and a pressure assembly that forms a fixing nip therebetween and includes a first adjuster and a second adjuster. The first adjuster includes a pressure cam, a first biasing device, a first pressure lever that holds the pressure rotator, and a second pressure lever that moves with the pressure cam and presses against the first pressure lever via the first biasing device. The first adjuster adjusts a load of the first biasing device to adjust a pressure force from the pressure rotator to the fixing rotator. The second adjuster includes an adjustment screw is driven into the second pressure lever, and a retainer that retains an adjusted state between the adjustment screw and the first pressure lever. The second adjuster adjusts a holding position of the first pressure lever to hold the pressure rotator.

10 Claims, 5 Drawing Sheets

(56) References Cited

U.S. PATENT DOCUMENTS

2009/0226227 A1* 9/2009 Furukata ..... G03G 15/206 399/328
2009/0274477 A1 11/2009 Okamoto et al.
2009/0274494 A1 11/2009 Okamoto et al.
2009/0274495 A1 11/2009 Okamoto et al.
2009/0274496 A1 11/2009 Okamoto et al.
2009/0274497 A1 11/2009 Okamoto et al.
2009/0274498 A1 11/2009 Okamoto et al.
2010/0316397 A1 12/2010 Kudou et al.
2011/0211880 A1* 9/2011 Furukata ..... G03G 15/2064 399/329
2011/0236069 A1* 9/2011 Arikawa ..... G03G 15/2028 399/122
2011/0236092 A1* 9/2011 Kanai ..... G03G 15/2053 399/331
2012/0044516 A1 2/2012 Hirose et al.
2012/0045260 A1 2/2012 Yamamoto et al.
2012/0051805 A1 3/2012 Suzuki et al.
2012/0224893 A1 9/2012 Yamamoto et al.
2012/0237229 A1* 9/2012 Okamoto ..... G03G 15/2032 399/33
2012/0251206 A1* 10/2012 Nakamura ..... G03G 15/206 399/329
2013/0142551 A1 6/2013 Yamano et al.
2014/0112680 A1 4/2014 Ueno et al.
2014/0119762 A1 5/2014 Suzuki et al.
2014/0212188 A1 7/2014 Watanabe
2014/0294461 A1 10/2014 Tokuda et al.
2015/0078770 A1 3/2015 Yamano et al.
2015/0098736 A1* 4/2015 Furukata ..... G03G 15/2032 399/329
2015/0227097 A1 8/2015 Yamano et al.
2015/0323892 A1 11/2015 Sakamaki et al.
2016/0004199 A1 1/2016 Suzuki et al.
2016/0124357 A1 5/2016 Ujiie et al.
2016/0124361 A1 5/2016 Watanabe et al.
2016/0170350 A1 6/2016 Hirose et al.
2016/0202646 A1 7/2016 Suzuki et al.
2016/0306304 A1 10/2016 Hemmi et al.
2016/0363898 A1 12/2016 Ujiie
2017/0090368 A1 3/2017 Ujiie et al.
2017/0097600 A1 4/2017 Kawata et al.
2017/0205745 A1 7/2017 Suzuki et al.
2017/0235259 A1 8/2017 Saitoh et al.
2017/0269522 A1 9/2017 Kubota et al.
2017/0269525 A1 9/2017 Okamoto et al.
2017/0269526 A1 9/2017 Yuasa et al.
2017/0357197 A1 12/2017 Okamoto et al.
2017/0357198 A1 12/2017 Namekata et al.
2018/0081309 A1 3/2018 Hirose et al.
2018/0088502 A1 3/2018 Sugiyama et al.

FOREIGN PATENT DOCUMENTS

JP 2009-014829 1/2009
JP 2012-194421 10/2012

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application No. 2017-137190, filed on Jul. 13, 2017, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image on a recording medium, and an image forming apparatus for forming an image on a recording medium with the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator.

The fixing device often includes a pressure assembly that presses the pressure rotator against the fixing rotator. The pressure assembly controls the pressure from the pressure rotator to the fixing rotator to reliably fix toner images on various types of recording media.

SUMMARY

In one embodiment of the present disclosure, a novel fixing device includes a fixing rotator, a pressure rotator, and a pressure assembly. The pressure rotator is configured to separably press against the fixing rotator. The pressure assembly is configured to form a fixing nip between the fixing rotator and the pressure rotator. A recording medium bearing a toner image is conveyed through the fixing nip. The pressure assembly includes a first adjuster and a second adjuster. The first adjuster includes a pressure cam, a first biasing device, a first pressure lever, and a second pressure lever. The first pressure lever is configured to hold the pressure rotator. The second pressure lever is configured to move in synchronization with the pressure cam and press against the first pressure lever via the first biasing device. The first adjuster is configured to adjust a load of the first biasing device to adjust a pressure force from the pressure rotator to the fixing rotator at a pressure position. The second adjuster includes an adjustment screw and a retainer. The adjustment screw is driven into the second pressure lever. The retainer is configured to retain an adjusted state between the adjustment screw and the first pressure lever. The second adjuster is configured to adjust a holding position of the first pressure lever to hold the pressure rotator at the pressure position.

Also described is a novel image forming apparatus incorporating the fixing device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
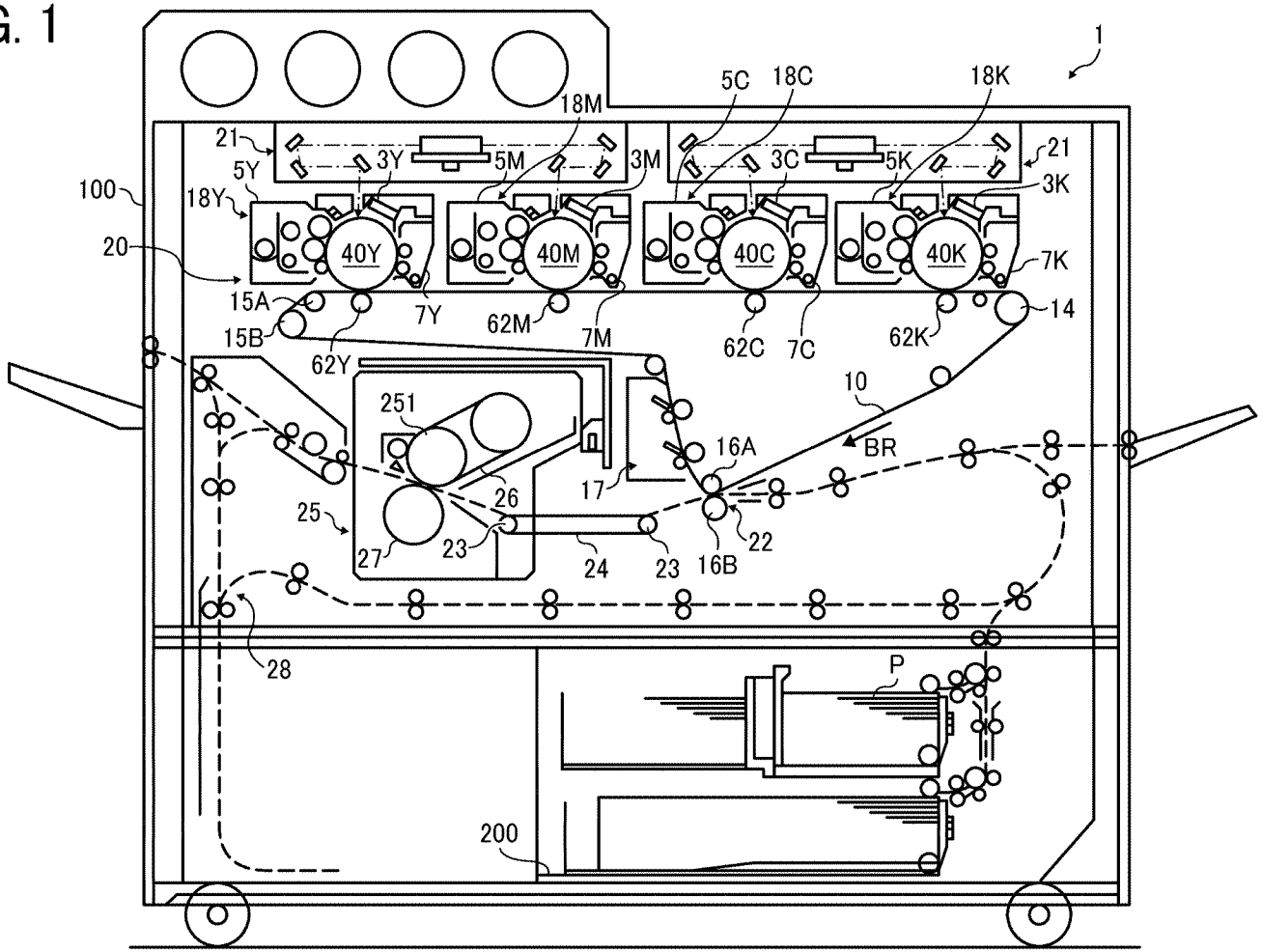
FIG. 1 is a schematic sectional view of an image forming apparatus according to an embodiment of the present disclosure.

In describing embodiments illustrated in the drawings, specific terminology is employed for the sake of clarity.

However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, M, C, and K denote colors yellow, magenta, cyan, and black, respectively. To simplify the description, these suffixes are omitted unless necessary.

Referring to the drawings, wherein like reference numerals designate identical or corresponding parts throughout the several views, embodiments of the present disclosure are described below.

Initially with reference to FIG. 1, a description is given of an overall configuration of an image forming apparatus 1 according to an embodiment of the present disclosure.

FIG. 1 is a schematic sectional view of the image forming apparatus 1.

The image forming apparatus 1 may be a copier, a facsimile machine, a printer, a multifunction peripheral or a multifunction printer (MFP) having at least two of copying, printing, scanning, facsimile, and plotter functions, or the like. In the present embodiment, the image forming apparatus 1 forms color and monochrome images on recording media by electrophotography. Alternatively, the image forming apparatus 1 may form a monochrome image on a recording medium. As illustrated in FIG. 1, the image forming apparatus 1 employs a tandem intermediate transfer system. The image forming apparatus 1 includes a body 100 and a sheet feeding table 200 under the body 100.

Inside the body 100 is an image forming portion (hereinafter referred to as a tandem image forming portion) 20 employing the tandem intermediate transfer system. The tandem image forming portion 20 includes a plurality of image forming devices 18Y, 18M, 18C, and 18K arranged side by side.

An endless intermediate transfer belt 10 serving as an intermediate transferor is situated in a substantially center portion of the body 100.

The intermediate transfer belt 10 is entrained around a plurality of support rollers 14, 15A, 15B, and 16A, thereby being rotatable in a clockwise direction of rotation BR in FIG. 1.

An intermediate transfer belt cleaner 17 is disposed on the left of the support roller 16A in FIG. 1.

The intermediate transfer belt cleaner 17 removes residual toner from the intermediate transfer belt 10. The residual toner herein refers to toner that has failed to be transferred from the intermediate transfer belt 10 onto a sheet P serving as a recording medium and therefore remains on the intermediate transfer belt 10.

Above an upper face of the intermediate transfer belt 10 stretched taut across the support rollers 14 and 15A, the four image forming devices 18Y, 18M, 18C, and 18K are aligned horizontally along the direction of rotation BR of the intermediate transfer belt 10, thereby constructing the tandem image forming portion 20. The four image forming devices 18Y, 18M, 18C, and 18K forms yellow, magenta, cyan, and black toner images, respectively.

The image forming devices 18Y, 18M, 18C, and 18K of the tandem image forming portion 20 include drum-shaped photoconductors 40Y, 40M, 40C, and 40K serving as image bearers that bear yellow, magenta, cyan, and black toner images, respectively.

As illustrated in FIG. 1, two exposure devices 21 are disposed above the tandem image forming portion 20.

The left exposure device 21 is disposed opposite the two image forming devices 18Y and 18M. The right exposure device 21 is disposed opposite the two image forming devices 18C and 18K.

Each of the two exposure devices 21 employs an optical scanning method. For example, each of the two exposure devices 21 includes two light sources (e.g., semiconductor lasers, semiconductor laser arrays, or multi-beam light sources), a coupling optical system, a common optical deflector (e.g., a polygon mirror), and two scanning-image forming optical systems.

The exposure devices 21 expose the photoconductors 40Y, 40M, 40C, and 40K according to yellow, magenta, cyan, and black image data to form electrostatic latent images on the photoconductors 40Y, 40M, 40C, and 40K, respectively.

Each of the photoconductors 40Y, 40M, 40C, and 40K is surrounded by various pieces of equipment. Specifically, in the image forming device 18Y, the photoconductor 40Y is surrounded by a charger 3Y, a developing device 5Y, a photoconductor cleaner 7Y. In the image forming device 18M, the photoconductor 40M is surrounded by a charger 3M, a developing device 5M, a photoconductor cleaner 7M. In the image forming device 18C, the photoconductor 40C is surrounded by a charger 3C, a developing device 5C, a photoconductor cleaner 7C. In the image forming device 18K, the photoconductor 40K is surrounded by a charger 3K, a developing device 5K, a photoconductor cleaner 7K. The chargers 3Y, 3M, 3C, and 3K uniformly charge the surface of the photoconductors 40Y, 40M, 40C, and 40K, respectively, before the exposure devices 21 expose the photoconductors 40Y, 40M, 40C, and 40K to form an electrostatic latent image on each of the photoconductors 40Y, 40M, 40C, and 40K. The developing devices 5Y, 5M, 5C, and 5K develop the electrostatic latent images thus formed with toner of yellow, magenta, cyan, and yellow into yellow, magenta, cyan, and black toner images, respectively. The photoconductor cleaners 7Y, 7M, 7C, and 7K remove residual toner from the photoconductors 40Y, 40M, 40C, and 40K. The residual toner herein refers to toner that has failed to be transferred from the photoconductors 40Y, 40M, 40C, and 40K onto the intermediate transfer belt 10 and therefore remains on the photoconductors 40Y, 40M, 40C, and 40K.

Primary transfer rollers 62Y, 62M, 62C, and 62K serving as primary transferors or primary transfer devices are disposed opposite the photoconductors 40Y, 40M, 40C, and 40K, respectively, via the intermediate transfer belt 10. Thus, the primary transfer rollers 62Y, 62M, 62C, and 62K forms primary transfer nips between the respective photoconductors 40Y, 40M, 40C, and 40K and the intermediate transfer belt 10, respectively. At the primary transfer nips, the yellow magenta, cyan, and black toner images are primarily transferred from the photoconductors 40Y, 40M, 40C, and 40K onto the intermediate transfer belt 10. Thus, a composite color toner image is formed on the intermediate transfer belt 10.

Among the plurality of support rollers 14, 15A, 15B, and 16A that supports the intermediate transfer belt 10, the support roller 14 is a driving roller that drives and rotates the intermediate transfer belt 10.

The support roller 14 is coupled to a motor through a driving force transmitter such as a gear, a pulley, or a belt.

In a print job to form a black toner image on the intermediate transfer belt 10, a mover moves the support rollers 15A and 15B while the support roller 14 remains at the same position, so as to separate the intermediate transfer belt 10 from the photoconductors 40Y, 40M, and 40C, which are used to form yellow, magenta, and cyan toner images, respectively.

A secondary transfer device 22 is disposed opposite the tandem image forming portion 20 via the intermediate transfer belt 10.

In the present example of FIG. 1, the secondary transfer device 22 includes a secondary transfer roller 16B that is pressed against the support roller 16A via the intermediate transfer belt 10. Here, the support roller 16A serves as a secondary transfer opposed roller. The secondary transfer roller 16B generates a transfer electric field to secondarily transfer the color toner image from the intermediate transfer belt 10 onto the sheet P herein serving as a transfer medium.

A fixing device 25 is disposed downstream from the secondary transfer device 22 in a direction of conveyance of the sheet P (hereinafter referred to as a sheet conveyance direction). In FIG. 1, the fixing device 25 is disposed on the left side of the secondary transfer device 22. The fixing device 25 receives the sheet P bearing the color toner image and fixes the color toner image onto the sheet P.

The fixing device 25 includes, e.g., an endless fixing belt 26, a pressure roller 27 pressed against the fixing belt 26, and a fixing roller 251.

The fixing belt 26 is entrained around two support rollers. One of the support rollers is the fixing roller 251.

A heater, such as a lamp or an induction heater employing an electromagnetic induction heating method, is disposed inside at least one of the support rollers.

After the secondary transfer device 22 transfers the color toner image onto the sheet P, a conveyor belt 24 supported by two rollers 23 conveys the sheet P bearing the color toner image to the fixing device 25.

Instead of the conveyor belt 24, a stationary guide, a conveyor roller, or the like may be used.

In the present example of FIG. 1, a sheet reverse device 28 is disposed below the secondary transfer device 22 and the fixing device 25, in parallel with the tandem image forming portion 20. The sheet reverse device 28 reverses and conveys the sheet P for duplex printing to print another toner image on a back side of the sheet P.

Figure 2B:
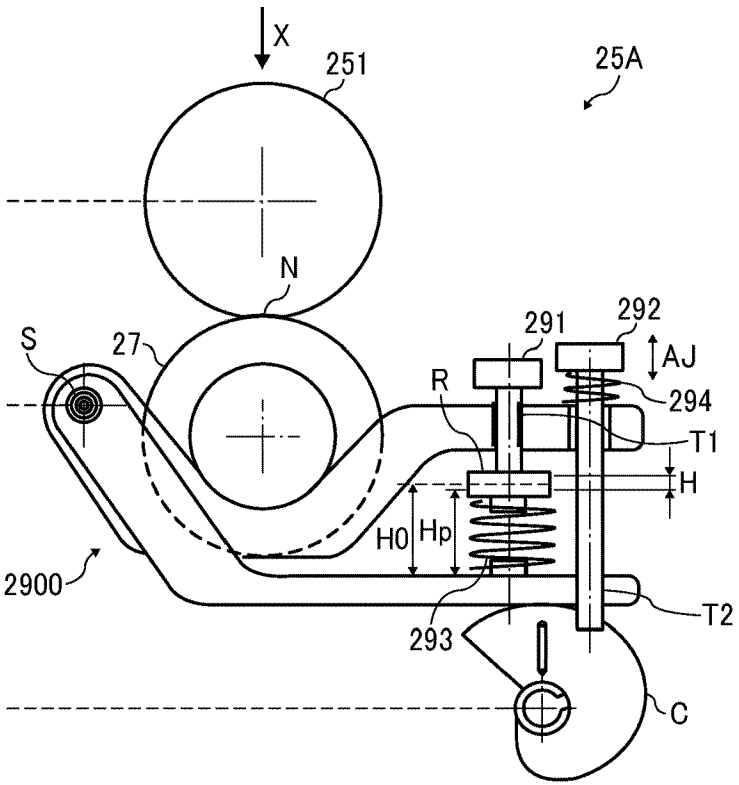
FIG. 2B is a sectional side view of the fixing device, particularly illustrating another positional example of the pressure assembly.
Figure 2A:
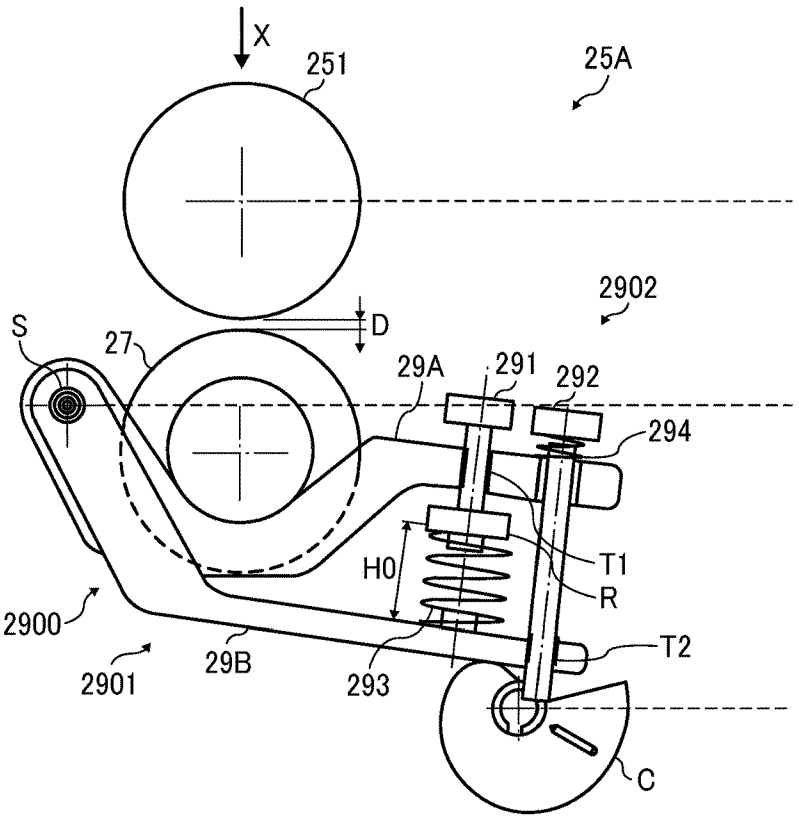
FIG. 2A is a sectional side view of a fixing device, particularly illustrating a positional example of a pressure assembly.
Figure 3:
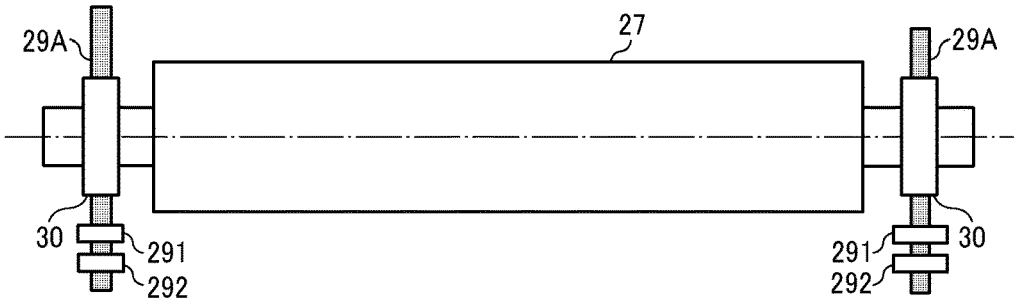
FIG. 3 is a top view of the fixing device of FIG. 2B in a direction X of a pressure roller in FIGS. 2A and 2B.

Referring now to FIGS. 2A through 3, a description is given of a fixing device 25A according to an embodiment of the present disclosure.

The fixing device 25A is incorporable in the image forming apparatus 1 described above, instead of the fixing device 25.

FIG. 2A is a sectional side view of the fixing device 25A, particularly illustrating a positional example of a pressure assembly 2900. FIG. 2B is a sectional side view of the fixing device 25A, particularly illustrating another positional example of the pressure assembly 2900. FIG. 3 is a top view of the fixing device 25A in a direction X of the pressure roller 27 in FIGS. 2A and 2B.

As illustrated in FIG. 2, the fixing device 25A includes, e.g., the fixing roller 251 serving as a fixing rotator, the pressure roller 27 serving as a pressure rotator, and the pressure assembly 2900. The pressure assembly 2900 presses the pressure roller 27 against the fixing roller 251 to form a contact area, herein referred to as a fixing nip N, between the fixing roller 251 and the pressure roller 27. The pressure assembly 2900 is also capable of separating the pressure roller 27 from the fixing roller 251. The pressure assembly 2900 includes, e.g., a pressure cam C, a first adjuster 2901, and a second adjuster 2902. The first adjuster 2901 includes, e.g., a first pressure lever 29A, a second pressure lever 29B, a compression spring 293 serving as a first biasing device, and a first adjustment screw 291. The second adjuster 2902 includes, e.g., a second adjustment screw 292 and a biasing spring 294 serving as a second biasing device.

As illustrated in FIG. 3, the first pressure lever 29A holds a journal as an end portion of the pressure roller 27 via a bearing 30.

Rotation of the pressure cam C presses the pressure roller 27 thus held by the first pressure lever 29A against the fixing roller 251.

A fulcrum S is a common rotation center on which the first pressure lever 29A and the second pressure lever 29B pivot. The compression spring 293 is interposed between the first pressure lever 29A and the second pressure lever 29B.

An elastic force of the compression spring 293 acts in a direction to separate the first pressure lever 29A and the second pressure lever 29B from each other, thereby pressing the first pressure lever 29A toward the fixing roller 251.

The first pressure lever 29A and the second pressure lever 29B are disposed such that the second pressure lever 29B compresses the compression spring 293 while applying pressure to cause the first pressure lever 29A to press the pressure roller 27 against the fixing roller 251.

With such a construction of the first pressure lever 29A and the second pressure lever 29B, a pressure force of the compression spring 293 acts on the fixing roller 251.

As illustrated in FIGS. 2A and 2B, the first pressure lever 29A is screwed with the first adjustment screw 291 at a position T1. The first adjustment screw 291 abuts against the compression spring 293 via a screw support R to adjust a nip load at the fixing nip N between the fixing roller 251 and the pressure roller 27.

For example, the first adjustment screw 291 is rotated to adjust a width of the fixing nip N such that the fixing nip N is formed having a given nip width when the pressure roller 27 is moved upward to press against the fixing roller 251 while the pressure cam C is rotated by a given angle to reach, e.g., a position illustrated in FIG. 2B. Note that the width of the fixing nip N (or fixing nip width) refers to a nip length of the fixing nip N (or fixing nip length) in the sheet conveyance direction perpendicular to an axial direction of the fixing roller 251 and the pressure roller 27.

In the present embodiment, the fixing nip N has a width of about 23 mm at a center portion in a longitudinal direction of the fixing nip N.

As illustrated in FIG. 3, the first adjustment screws 291 are disposed on opposed end sides of the pressure roller 27 in the axial direction of the pressure roller 27. In a case in which uneven pressure is applied at the fixing nip N in the sheet conveyance direction, at least one of the first adjustment screws 291 is adjusted as appropriate to eliminate the pressure unevenness at the fixing nip N.

In a case in which a pressure position of the pressure roller 27 is controlled to press against the fixing roller 251 to form the fixing nip N, the height of the compression spring 293 changes from a height HO in a non-pressure state to a height Hp in a pressure state.

A description of a compressed amount of height H is deferred.

As described above, the first adjuster 2901 includes the first pressure lever 29A, the second pressure lever 29B, the compression spring 293, and the first adjustment screw 291.

With continued reference to FIGS. 2A and 2B, a description is now given of the second adjuster 2902.

The second adjuster 2902 includes the second adjustment screw 292 and the biasing spring 294.

The second pressure lever 29B is screwed with the second adjustment screw 292.

The biasing spring 294 is interposed between a screw head of the second adjustment screw 292 and the first pressure lever 29A to retain an adjusted state between the second adjustment screw 292 and the first pressure lever 29A. Thus, the biasing spring 294 serves as a retainer that retains the adjusted state between the second adjustment screw 292 and the first pressure lever 29A.

With such a configuration, the second adjuster 2902 adjusts a position of a holding point PH as a holding position to hold the pressure roller 27.

As illustrated in FIG. 2A, the second pressure lever 29B is separated from the first pressure lever 29A while contacting the pressure cam C.

That is, the angle of rotation of the pressure cam C determines the position of the second pressure lever 29B.

On the other hand, the position of the first pressure lever 29A changes by how much the second pressure lever 29B is tightened at a position T2 by the second adjustment screw 292 that couples the first pressure lever 29A and the second pressure lever 29B.

For example, when the second adjustment screw 292 is loosened, the elastic force of the compression spring 293 in a pressing direction displaces the first pressure lever 29A in the pressing direction to approach the fixing roller 251.

By contrast, when the second adjustment screw 292 is tightened, the first pressure lever 29A is displaced in a pressure releasing direction to separate from the fixing roller 251, against the elastic force of the compression spring 293 in the pressing direction.

Thus, the fixing nip width is adjustable with the second adjustment screw 292.

Figure 5A:
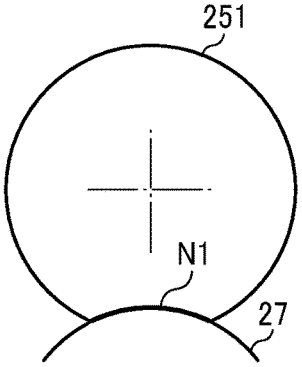
FIG. 5A is a sectional side view of the pressure roller and a fixing roller, illustrating a first example of a fixing nip formed therebetween.
Figure 5B:
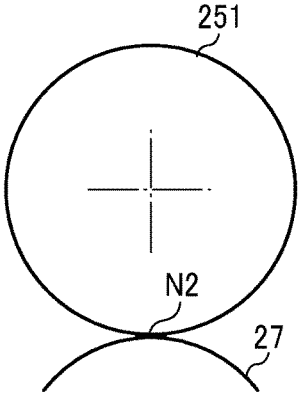
FIG. 5B is a sectional side view of the pressure roller and the fixing roller, illustrating a second example of the fixing nip formed therebetween.

A description is now given of a fixing nip narrower than the fixing nip having a width of about 23 mm described above. Here, the fixing nip having a width of about 23 mm is referred to as a first fixing nip N1 as illustrated in FIG. 5A. The fixing nip narrower than the first fixing nip N1 is referred to as a second fixing nip N2 as illustrated in FIG. 5B.

In the present example, the angle of rotation of the pressure cam C is controlled to press the pressure roller 27 against the fixing roller 251 to form the second fixing nip N2 having a width of about 5 mm.

When the pressure roller 27 is moved to a first pressure position at which the pressure roller 27 is pressed against the fixing roller 251 to form the first fixing nip N1 therebetween, the repulsive force from the fixing roller 251 changes the height of the compression spring 293 by H mm (i.e., H =H0−Hp).

When the pressure roller 27 is moved to a second pressure position at which the pressure roller 27 is pressed against the fixing roller 251 to form the second fixing nip N2 therebetween, the repulsive force from the fixing roller 251 is relatively small.

When a repulsive force Fr from the fixing roller 251 at the second fixing nip N2 is smaller than a contact-pressure force corresponding to a load F0 of the compression spring 293 having the height H0 as a compressed amount in the non-pressure state, the compression spring 293 is not displaced.

In short, under the conditions of the second fixing nip N2, the spring load of the compression spring 293 does not act. The acting force on the fixing roller 251 is determined entirely by the position of the pressure roller 27.

Under such conditions, a nip amount of the second fixing nip N2 is adjustable by adjustment of the second adjustment screw 292.

Specifically, the second fixing nip N2 is adjustable without affecting an adjusted state of the first fixing nip N1 provided that an adjusted amount AJ of the second adjustment screw 292 of the second adjuster 2902 is not greater than the height change "H" described above.

The second pressure lever 29B is screwed with the second adjustment screw 292 of the second adjuster 2902.

A retainer, such as a spring or a nut, retains the second adjustment screw 292 to maintain the adjusted states of the second adjustment screw 292 and the second fixing nip N2.

FIGS. 2A and 2B illustrate the biasing spring 294 as the retainer that retains an adjusted state with the second adjustment screw 292.

As illustrated in FIGS. 2A and 2B, the biasing spring 294 is interposed between the screw head of the second adjustment screw 292 and the first pressure lever 29A to retain a state fastened or loosened by the second adjustment screw 292.

Alternatively, a nut may be used as the retainer.

Figure 4:
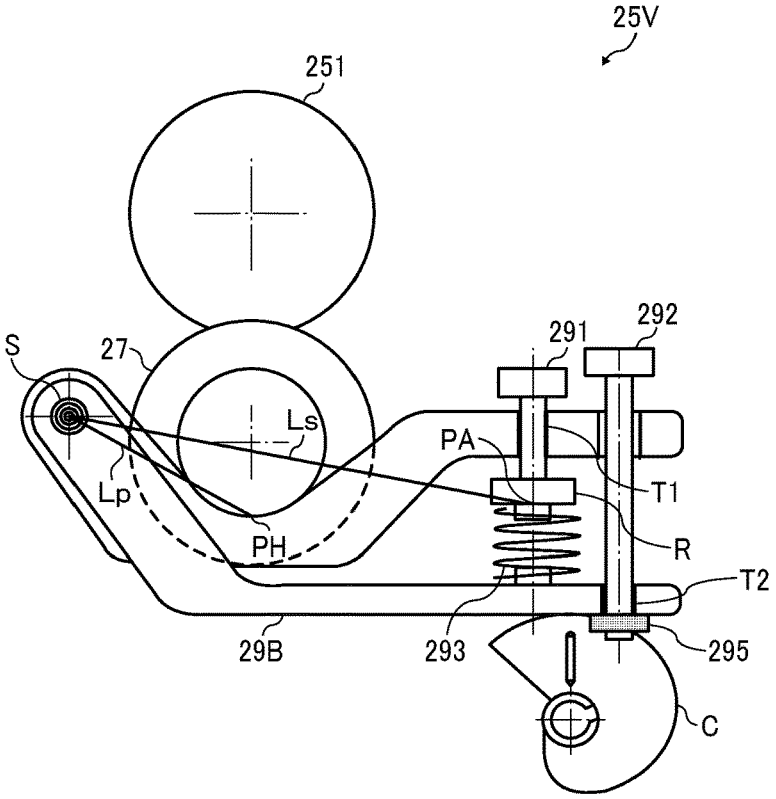
FIG. 4 is a sectional side view of a fixing device incorporating a fixing nut, illustrating an adjusted state with an adjustment screw and the fixing nut.

Referring now to FIG. 4, a description is given of a fixing nut 295 used as the retainer.

FIG. 4 is a sectional side view of a fixing device 25V incorporating the fixing nut 295, illustrating an adjusted state with the second adjustment screw 292 and the fixing nut 295.

The fixing device 25A and the fixing device 25V have substantially the same configurations, except that the fixing device 25V includes the fixing nut 295 instead of the biasing spring 294 as the retainer.

As illustrated in FIG. 4, the fixing nut 295 is coupled to a tip of the second adjustment screw 292 passing through the second pressure lever 29B and projecting toward the pressure cam C.

The fixing nut 295 retains the fastened state or the loosened state with the second adjustment screw 292.

Thus, the retainer (i.e., biasing spring 294 or fixing nut 295) secures or biases the second adjustment screw 292 to prevent the second adjustment screw 292 from being loosened. In short, the retainer retains the adjusted state with the second adjustment screw 292.

Accordingly, adjusted nip conditions are maintained over years, even when the first fixing nip N1 and the second fixing nip N2 are alternately formed.

In the fixing device 25A or the fixing device 25V having the configurations described above, a toner image is fixed on a recording medium. For example, when a toner image is fixed on thin paper, the first pressure position is selected to form the first fixing nip N1. The toner image is fixed on the thin paper while the thin paper is conveyed through the first fixing nip N1.

As illustrated in FIG. 2B, the fixing roller 251 has a rubber thickness greater than a rubber thickness of the pressure roller 27.

With such a configuration, the first fixing nip N1 is oriented toward the pressure roller 27, thereby facilitating separation of melting toner contained in the toner image on the recording medium (e.g., thin paper) from a fixing rotator (e.g., fixing roller 251). Even when the toner image is formed on a leading end of the thin paper, the thin paper reliably separates from the fixing rotator after the toner image is fixed on the thin paper.

In the present example, the fixing roller 251 has a rubber thickness of about 15 mm. The pressure roller 27 has a rubber thickness of about 3 mm.

Each of the fixing roller 251 and the pressure roller 27 has an outer diameter including a rubber portion of about φ65.

A description is now given of a case in which an image is printed on an envelope.

In a case in which the envelope is conveyed through the first fixing nip N1 that curves to direct downwards (i.e., toward the pressure roller 27) the envelope exiting the first fixing nip N1, the envelope may be wrinkled due to the curvature of the first fixing nip N1.

Specifically, the curvature generates a difference between a linear velocity on a fixing-rotator side of the envelope and a linear velocity on a pressure-rotator side of the envelope. Such a linear velocity difference wrinkles the envelope. Note that the fixing rotator side of the envelope faces the fixing roller 251 while the pressure rotator side of the envelope faces the pressure roller 27.

A flat and narrower fixing nip (e.g., second fixing nip N2 illustrated in FIG. 5B) addresses such a situation. In other words, a narrower fixing nip prevents the envelope form being wrinkled.

However, the unevenness of the narrower fixing nip in the sheet conveyance direction is greater in sensitivity to variations in accuracy of components (e.g., pressure levers) of the pressure assembly 2900 than the unevenness of the first fixing nip N1 in the sheet conveyance direction.

For example, when the first fixing nip N1 is formed, the unevenness of the first fixing nip N1 in the sheet conveyance direction is adjusted to be not greater than about 0.1 mm with the first adjuster 2901.

On the other hand, when the second fixing nip N2 (i.e., narrower fixing nip) is formed, the unevenness of the second fixing nip N2 in the sheet conveyance direction may be about 1 mm.

Under such nip conditions, for example, a leading side of the second fixing nip N2 in the sheet conveyance direction may be formed to be a target fixing nip to suitably fix a toner image on an envelope while a trailing side of the second fixing nip N2 in the sheet conveyance direction may not be a target fixing nip.

To form the second fixing nip N2 evenly in the sheet conveyance direction, the leading and trailing sides of the second fixing nip N2 is adjusted individually in the present embodiment.

Specifically, according to the present embodiment, the fixing device (e.g., fixing devices 25A, 25V) includes a pressure assembly (e.g., pressure assembly 2900) that includes a first adjuster (e.g., first adjuster 2901) and a second adjuster (e.g., second adjuster 2902).

The pressure assembly is controlled to adjust the fixing nip N to be suitable for fixing a toner image on an envelope while maintaining the state of the pressure assembly adjusted to form the first fixing nip N1.

Accordingly, the envelope is stably conveyed through the fixing nip.

Insufficient heat may be supplied to the envelope at a narrower fixing nip.

To supply sufficient heat to the envelope, the envelope is preferably conveyed slower through the second fixing nip N2 compared to a case in which the envelope is conveyed through the first fixing nip N1.

The compression spring 293 has a load of about 700 N when pressing the first pressure lever 29A, thereby generating a pressure force of the first pressure lever 29A.

The load becomes smaller for a longer distance Ls between the fulcrum S and a point of act PA of the spring load (i.e., compression spring 293) due to leverage with respect to a distance Lp between the fulcrum S and the holding point PH that holds the pressure roller 27.

As illustrated in FIG. 4, satisfying a relationship of Lp<Ls reduces the stress acting on the first pressure lever 29A, thereby obviating reinforcement of the first pressure lever 29A and attaining a simple and inexpensive configuration of the pressure assembly 2900.

In the fixing devices 25A and 25V of the present embodiment described above with reference to FIGS. 2A through 5, the pressure assembly 2900 presses the pressure roller 27 against the fixing roller 251. In the fixing device 25 as illustrated in FIG. 1, the pressure assembly 2900 presses the pressure roller 27 against the fixing belt 26 entrained around the fixing roller 251 and, e.g., at least one heating roller.

Figure 6A:
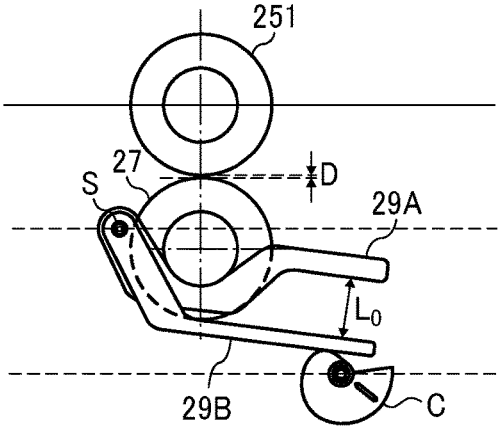
FIG. 6A is a sectional side view of the fixing device, illustrating the pressure assembly in a non-pressure state.

Referring now to FIGS. 6A thorough 6D, a description is given of operation of the pressure assembly 2900.

Figure 6B:
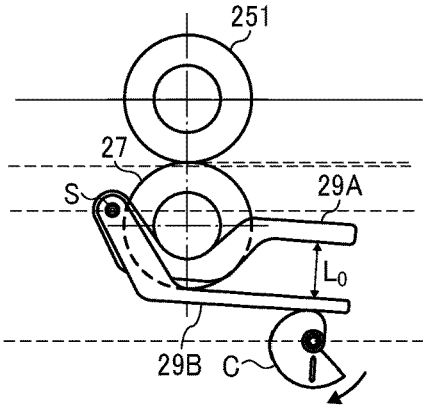
FIG. 6B is a sectional side view of the fixing device, illustrating the pressure assembly in a narrow nip state.
Figure 6C:
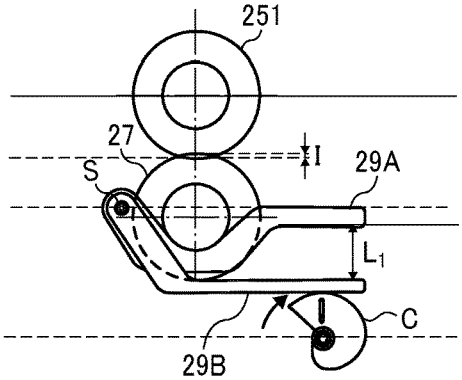
FIG. 6C is a sectional side view of the fixing device, illustrating the pressure assembly in a normal nip state.
Figure 6D:
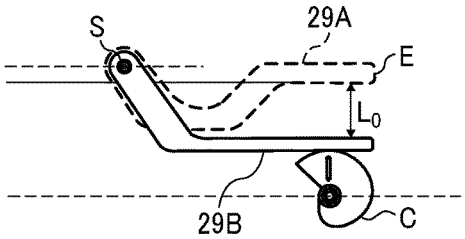
FIG. 6D is a sectional side view of the fixing device, illustrating the pressure assembly in the normal nip state with a distance remaining unchanged between pressure levers.

FIG. 6A is a sectional side view of the fixing device 25A, illustrating the pressure assembly 2900 in a non-pressure state. FIG. 6B is a sectional side view of the fixing device 25A, illustrating the pressure assembly 2900 in a narrow nip state. FIG. 6C is a sectional side view of the fixing device 25A, illustrating the pressure assembly 2900 in a normal nip state. FIG. 6D is a sectional side view of the fixing device 25A, illustrating the pressure assembly 2900 in the normal nip state with a distance Lo remaining unchanged between the first pressure lever 29A and the second pressure lever 29B.

In FIGS. 6A though 6D, the positions of the second adjustment screws 292 disposed on the opposed end sides of the pressure roller 27 in the axial direction thereof are adjusted individually in advance to obtain an optimum fixing nip width at each of opposed end portions of the pressure roller 27 even when a narrower fixing nip is formed, regardless of the tolerance of the pressure cam C.

For example, in the non-pressure state illustrated in FIG. 6A, the compression spring 293 of the first adjuster 2901 maintains pressure in directions to separate the first pressure lever 29A and the second pressure lever 29B from each other.

Meanwhile, the second pressure lever 29B is adjustably screwed with the second adjustment screw 292 of the second adjuster 2902 to adjust the distance between the first pressure lever 29A and the second pressure lever 29B, thereby providing a distance D between the pressure roller 27 and the fixing roller 251.

In the narrow nip state illustrated in FIG. 6B, the first pressure lever 29A and the second pressure lever 29B moves together.

In the narrow nip state, a reaction force from the fixing roller 251 is smaller than a lever load.

Therefore, the first pressure lever 29A and the second pressure lever 29B moves together while maintaining the distance $L_0$ therebetween of the non-pressure state illustrated in FIG. 6A, so that the pressure roller 27 comes into contact with the fixing roller 251.

Specifically, at the time of pressurizing, the pressure cam C rotates to move both the first pressure lever 29A and the second pressure lever 29B toward the fixing roller 251.

The elastic force in an extension direction of the compression spring 293 of the first adjuster 2901 is stronger than the force of the pressure cam C to push up the second pressure lever 29B.

Therefore, the first pressure lever 29A and the second pressure lever 29B are pivoted together on the fulcrum S with the distance Lo remaining unchanged therebetween, so as to form a narrow nip between the pressure roller 27 and the fixing roller 251.

The pressure roller 27 coming into contact the fixing roller 251 presses an elastic layer of the fixing roller 251 while maintaining the distance Lo between the first pressure lever 29A and the second pressure lever 29B.

As the pressure roller 27 keeps applying pressure after the elastic layer of the fixing roller 251 becomes unable to be pressed any further, the first pressure lever 29A stops moving.

In the normal nip state illustrated in FIG. 6C, the second pressure lever 29B moves alone.

The second pressure lever 29B approaches the first pressure lever 29A while compressing the compression spring 293 of the first adjuster 2901 to a position where the second pressure lever 29B is apart from the first pressure lever 29A at a distance $L_1$.

That is, since the reaction force from the fixing roller 251 exceeds the lever load, the first pressure lever 29A remains at a given position or in a given positional range while the second pressure lever 29B is pushed up by the pressure cam C.

A spring load and the reaction force from the fixing roller 251 becomes balanced when the second pressure lever 29B reaches the position where the second pressure lever 29B is apart from the first pressure lever 29A at the distance $L_1$. When the first pressure lever 29A and the second pressure lever 29B are apart from each other at the distance $L_1$, the pressure roller 27 encroaches upon the fixing roller 251 at a distance I.

As described above, the second pressure lever 29B is screwed with the second adjustment screw 292 of the second adjuster 2902.

Therefore, as the second pressure lever 29B gets closer to the first pressure lever 29A, the first pressure lever 29A separates farther from the screw head of the second adjustment screw 292. In other words, the second adjustment screw 292 passes through and projects farther from the first pressure lever 29A.

Accordingly, as described above with reference to the non-pressure state illustrated in FIG. 6A, the distance between the first pressure lever 29A and the screw head of the second adjustment screw 292 of the second adjuster 2902 is adjusted in advance, that is, a screwed amount of the second pressure lever 29B with the second adjustment screw 292 is adjusted in advance, so as to reduce unevenness in nip amount in the axial direction of the pressure roller 27 even when the pressure cams C move at the same time on the opposed end sides of the pressure roller 27, regardless of the tolerance of the pressure cams C.

With such a configuration capable of adjusting levers, the pressure assembly 2900 presses the pressure roller 27 against the fixing roller 251 to form an even normal fixing nip or an even narrower fixing nip in the sheet conveyance direction.

Accordingly, the fixing devices 25A and 25V reliably fix a toner image on various types of recording media including an envelope.

Note that, as illustrated in FIG. 6D, in a case in which the fixing roller 251 is not provided, the first pressure lever 29A is displaced to a position E with the distance $L_0$ remaining unchanged between the first pressure lever 29A and the second pressure lever 29B in the normal nip state.

As described above, in the present embodiment, the fixing device 25A includes the fixing roller 251 serving as a fixing rotator, the pressure roller 27 serving as a pressure rotator, and the pressure assembly 2900. The pressure roller 27 separably presses against the fixing roller 251. The pressure assembly 2900 forms the fixing nip N between the fixing roller 251 and the pressure roller 27. The fixing device 25A fixes a toner image on a recording medium while the recording medium is conveyed through the fixing nip N.

The pressure assembly 2900 includes the first adjuster 2901 and the second adjuster 2902.

The first adjuster 2901 includes the pressure cam C, the compression spring 293 serving as a first biasing device, the first pressure lever 29A, and the second pressure lever 29B. The first pressure lever 29A holds the pressure roller 27. The second pressure lever 29B moves in synchronization with the pressure cam C and presses against the first pressure lever 29A via the compression spring 293.

The first adjuster 2901 adjusts a load of the compression spring 293, thereby adjusting a pressure force from the pressure roller 27 to the fixing roller 251 at a pressure position.

On the other hand, the second adjuster 2902 adjusts the holding position (i.e., position of the holding point PH) of the first pressure lever 29A to hold the pressure roller 27 at the pressure position.

The second adjuster 2902 includes the second adjustment screw 292 and a retainer. The second adjustment screw 292 is driven into the second pressure lever 29B. The retainer retains an adjusted state between the second adjustment screw 292 and the first pressure lever 29A.

The pressure assembly 2900 adjusts the fixing nip width with the load adjustment by the first adjuster 2901 and the positional adjustment by the second adjuster 2902.

The pressure position includes a first pressure position at which a first fixing nip width is obtained, and a second pressure position at which a second fixing nip width smaller than the first fixing nip width is obtained. The first adjuster 2901 adjusts the pressure force to the fixing roller 251 to obtain the first fixing nip width (e.g., first fixing nip N1).

On the other hand, at the second pressure position, the second adjuster 2902 adjusts a pressure unevenness of the fixing nip N having the second fixing nip width (i.e., second fixing nip N2) in the sheet conveyance direction.

With the first adjuster 2901 and the second adjuster 2902, the nip width and the pressure unevenness of the fixing nip N in the sheet conveyance direction are adjusted in different nip states.

The second adjuster 2902 includes the biasing spring 294 as the retainer. The biasing spring 294 also serves as a second biasing device. The biasing spring 294 is interposed between the first pressure lever 29A and the screw head of the second adjustment screw 292.

A biasing force of the biasing spring 294 retains the adjusted state between the second adjustment screw 292 and the first pressure lever 29A.

With such a configuration, the pressure assembly 2900 maintains, during operation, a state adjusted by the first adjuster 2901 and the second adjuster 2902.

Alternatively, the second adjuster 2902 may include the fixing nut 295 as the retainer. In such a case, the fixing nut 295 may be coupled to a tip of the second adjustment screw 292 to fix the second adjustment screw 292 and the first pressure lever 29A. The tip of the second adjustment screw 292 projects from the second pressure lever 29B.

As the fixing nut 295 fixes the second adjustment screw 292 and the first pressure lever 29A to retain the adjusted state therebetween, the pressure assembly 2900 maintains, during operation, the state adjusted by the first adjuster 2901 and the second adjuster 2902.

In the pressure assembly 2900, the compression spring 293 is subjected to a given load F0 as a first load in the non-pressure state.

At the first pressure position, the compression spring 293 is compressed and subjected to a load F1 as a second load.

At the second pressure position, the load F1 is not applied on the compression spring 293.

The adjusted amount AJ of the second adjuster 2902 is not greater than the compressed amount H of the compression spring 293 subjected to the load F1.

Thus, the state adjusted by the second adjuster 2902 does not affect the state adjusted by the first adjuster 2901. That is, adjustment values of the first adjuster 2901 and the second adjuster 2902 are determined independently from each other.

The pressure roller 27 has a thickness greater than a thickness of the fixing roller 251.

The pressure assembly 2900 presses the pressure roller 27 against the fixing roller 251 to form the fixing nip N through which the recording medium is conveyed and directed toward the pressure roller 27 at an exit of the fixing nip N.

In the narrow nip state, a flat nip is selectable so as not to wrinkle an envelope as the recording medium.

In addition, in a case in which thin paper is conveyed, the pressure roller 27 is further moved to the fixing roller 251 to apply a greater pressure force to the fixing roller 251 than a pressure force applied at the flat nip.

The formation of the fixing nip N to direct the recoding medium toward the pressure roller 27 at the exit of the fixing nip N facilitates separation of the thin paper from the fixing roller 251.

In a case in which an envelope is conveyed as the recording medium through the fixing nip N, the pressure assembly 2900 presses the pressure roller 27 against the fixing roller 251 to form the fixing nip N having the second fixing nip width (i.e., second fixing nip N2) therebetween.

The envelope is conveyed slower than the envelope conveyed through the fixing nip N having the first fixing nip width (i.e., first fixing nip N1).

In a case in which the second fixing nip N2 (i.e., narrow and flat nip) is selected to prevent the envelope from being wrinkled while the envelope is conveyed, fixability may be reduced due to a decrease in nip amount.

To maintain good fixability, the envelope is conveyed slower, thereby reducing a fixing speed to fix a toner image on the envelope, compared to the fixing speed in the normal nip state.

Accordingly, the toner image is reliably fixed on the envelope with sufficient heat.

In the pressure assembly 2900, the first pressure lever 29A and the second pressure lever 29B are pressed against each other while rotating about the fulcrum S.

A relation of $Lp<Ls$ is satisfied to obtain a given nip amount with a smaller spring load. Lp represents a distance between the fulcrum S and the holding point PH of the first pressure lever 29A to hold the pressure roller 27. Ls represents a distance between the fulcrum S and the point of act PA of the compression spring 293.

Accordingly, the stress applied to the lever (e.g., first pressure lever 29A) is reduced. As a consequence, the pressure assembly 2900 has a simpler configuration than a typical configuration.

An image forming apparatus (e.g., image forming apparatus 1) including the fixing device (e.g., fixing devices 25, 25A, 25V) described above provides reliable print quality supported by good fixing and conveyance qualities with respect to various types of recording media such as plain paper, thin paper, and envelopes.

According to the embodiments described above, a narrow fixing nip is kept stable to reliably fix a toner image on various types of recording media, particularly envelopes.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from that described above.

What is claimed is:

1. A fixing device comprising:

a fixing rotator;

a pressure rotator configured to separably press against the fixing rotator; and a pressure assembly configured to form a fixing nip between the fixing rotator and the pressure rotator, a recording medium bearing a toner image being conveyed through the fixing nip, the pressure assembly including:

a first adjuster including:

a pressure cam;

a first biasing device;

a first pressure lever configured to hold the pressure rotator; and a second pressure lever configured to move in synchronization with the pressure cam and press against the first pressure lever via the first biasing device, the first adjuster configured to adjust a load of the first biasing device to adjust a pressure force from the pressure rotator to the fixing rotator at a pressure position; and a second adjuster including:

an adjustment screw driven into the second pressure lever; and a retainer configured to retain an adjusted state between the adjustment screw and the first pressure lever, the second adjuster configured to adjust a holding position of the first pressure lever to hold the pressure rotator at the pressure position.

2. The fixing device according to claim 1,
wherein, the pressure position includes:
a first pressure position at which a first fixing nip width is obtained; and
a second pressure position at which a second fixing nip width smaller than the first fixing nip width is obtained,
wherein the first adjuster adjusts the pressure force to the fixing rotator to obtain the first fixing nip width, and
wherein, at the second pressure position, the second adjuster adjusts a pressure unevenness of the fixing nip having the second fixing nip width in a direction of conveyance of the recording medium.

3. The fixing device according to claim 2,
wherein the first biasing device of the pressure assembly is subjected to a first load in a non-pressure state,
wherein, at the first pressure position, the first biasing device is compressed and subjected to a second load,
wherein, at the second pressure position, the second load is not applied on the first biasing device, and
wherein an adjusted amount of the second adjuster is not greater than a compressed amount of the first biasing device subjected to the second load.

4. The fixing device according to claim 1,
wherein the retainer is a second biasing device interposed between the first pressure lever and a screw head of the adjustment screw, and
wherein a biasing force of the second biasing device retains the adjusted state between the adjustment screw and the first pressure lever.

5. The fixing device according to claim 1,
wherein the retainer is a fixing nut coupled to a tip of the adjustment screw to fix the adjustment screw and the first pressure lever, wherein the tip of the adjustment screw projects from the second pressure lever.

6. The fixing device according to claim 1,
wherein the pressure rotator has a thickness greater than a thickness of the fixing rotator, and
wherein the pressure assembly presses the pressure rotator against the fixing rotator to form the fixing nip through which the recording medium is conveyed and directed toward the pressure rotator at an exit of the fixing nip.

7. The fixing device according to claim 1,
wherein an envelope is conveyed as the recording medium through the fixing nip having a second fixing nip width, and
wherein the envelope is conveyed slower than the envelope conveyed through the fixing nip having a first fixing nip width.

8. The fixing device according to claim 1,
wherein the first pressure lever and the second pressure lever are pressed against each other while rotating about a fulcrum, and
wherein a relation of $Lp<Ls$ is satisfied, where Lp represents a distance between the fulcrum and a holding point of the first pressure lever to hold the pressure rotator, and Ls represents a distance between the fulcrum and a point of act of the first biasing device.

9. The fixing device according to claim 1, wherein the fixing rotator includes one of an endless belt and a roller.

10. An image forming apparatus comprising:
an image forming device configured to form a toner image; and
a fixing device configured to fix the toner image on a recording medium,
the fixing device including:
a fixing rotator;
a pressure rotator configured to separably press against the fixing rotator; and
a pressure assembly configured to form a fixing nip between the fixing rotator and the pressure rotator, the recording medium bearing the toner image being conveyed through the fixing nip,
the pressure assembly including:
a first adjuster including:
a pressure cam;
a first biasing device;
a first pressure lever configured to hold the pressure rotator; and
a second pressure lever configured to move in synchronization with the pressure cam and press against the first pressure lever via the first biasing device,
the first adjuster configured to adjust a load of the first biasing device to adjust a pressure force from the pressure rotator to the fixing rotator at a pressure position; and
a second adjuster including:
an adjustment screw driven into the second pressure lever; and
a retainer configured to retain an adjusted state between the adjustment screw and the first pressure lever,
the second adjuster configured to adjust a holding position of the first pressure lever to hold the pressure rotator at the pressure position.

* * * * *